United States Patent [19]

Ishihara et al.

[11] Patent Number: 4,824,516

[45] Date of Patent: Apr. 25, 1989

[54] PAVEMENT-MARKING TAPE APPLICATOR

[75] Inventors: Yuji Ishihara; Akio Yamasaki, both of Tochigi, Japan

[73] Assignee: Seibu Polymer Kasei Kabushiki Kaishas, Tokyo, Japan

[21] Appl. No.: 938,724

[22] Filed: Dec. 5, 1986

[30] Foreign Application Priority Data

Dec. 16, 1985 [JP] Japan ..... 60-193262[U]
Mar. 11, 1986 [JP] Japan ..... 61-35753[U]
Mar. 11, 1986 [JP] Japan ..... 61-35754

[51] Int. Cl.[4] ..... E01C 23/16

[52] U.S. Cl. ..... 156/523; 156/577; 156/579; 404/94

[58] Field of Search ..... 156/71, 522, 523, 526, 156/527, 574, 576, 577, 579, 510; 404/94; 83/471.2, 483, 485, 487, 508

[56] References Cited

U.S. PATENT DOCUMENTS

| | | | |
|---|---|---|---|
| 355,589 | 1/1887 | Collins | 83/471.2 |
| 1,204,761 | 11/1916 | Hall | 156/576 |
| 4,003,281 | 1/1977 | Kumpf et al. | 832/508 |
| 4,086,121 | 4/1978 | Ames | 156/526 |
| 4,317,696 | 3/1982 | Hutchinson et al. | 404/94 |
| 4,328,061 | 5/1982 | Off et al. | 156/522 |
| 4,406,201 | 9/1983 | Barnes et al. | 83/508 |
| 4,522,679 | 6/1985 | Funakoshi et al. | 156/523 |
| 4,565,467 | 1/1986 | Eigenmann | 404/94 |
| 4,665,787 | 5/1987 | Arnold et al. | 83/508 |

*Primary Examiner*—Michael Witshyn
*Attorney, Agent, or Firm*—Koda and Androlia

[57] ABSTRACT

A pavement-marking tape applicator comprises a carrier which has at least one wheel and an application roller and moves along a paved surface on which a pavement-marking tape is to be applied. A roll of pavement-marking tape is unwindably supported on the carrier. A pair of free end position adjusting rollers are mounted on the carrier for holding the unwound tape at such a position that the tape hangs in front of the application roller. The free end position adjusting rollers are capable of finely adjusting the free end position of the tape. A drive mechanism for manually or electrically rotating these free end position adjusting rollers is provided. In one aspect of the invention the pavement-marking tape applicator comprises a cutter mounted on the carrier for cutting the tape after completion of application of the tape on the paved surface. This cutter comprises a transversely extending rail, a disc-like rotary blade supported on a support member which is slidable on the rail, stationary blade which cuts the tape in association with the rotary blade and an actuating mechanism for actuating the rotary blade support member for sliding movement along the rail.

9 Claims, 9 Drawing Sheets

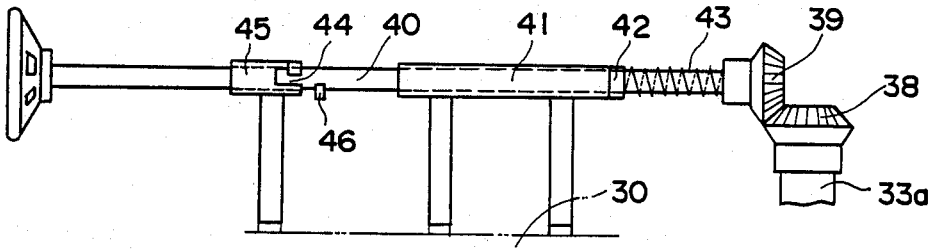
FIG. 8
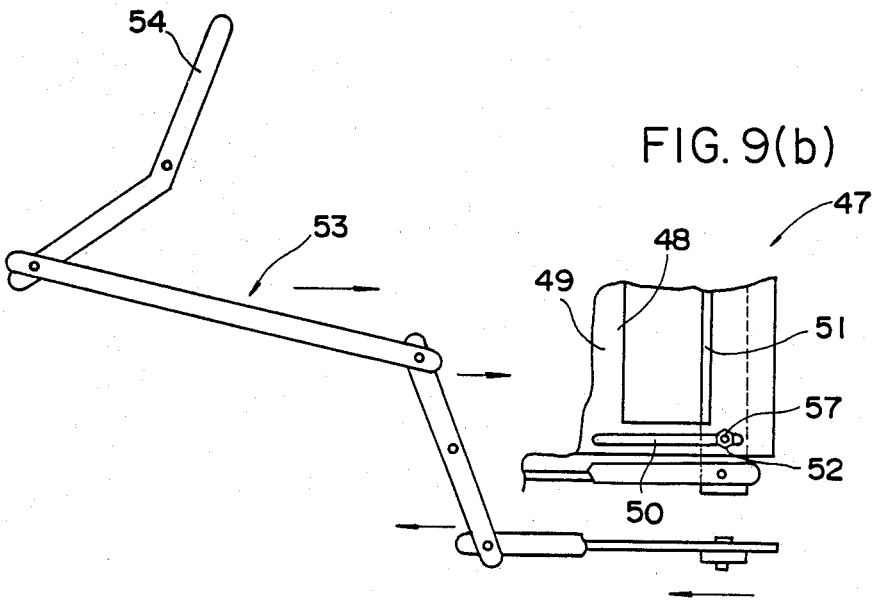
FIG. 9(b)
FIG. 9(a)

PAVEMENT-MARKING TAPE APPLICATOR

BACKGROUND OF THE INVENTION

This invention relates to an improvement of a pavement-marking tape applicator and, more particularly, to a pavement-marking tape applicator capable of readily adjusting a free end position of the tape at the start of application of the tape on the paved surface and of readily cutting the tape.

For pavement marking such as a center line on a paved surface, conventional application of coating is often replaced by use of a pavement-marking tape which is improved in reflectivity by having glass beads embedded therein.

The pavement-marking tape is usually in the form of a roll and it must be unwound from the roll and pressed against the paved surface for application on the paved surface.

For the purpose of efficiently performing such application operation, U.S. Pat. No. 4,242,173 discloses a specific apparatus made for this purpose which is shown in FIG. 10.

In this prior art apparatus, a front wheel of an applicator 2 having a handle 1 serves as a tape application roller 3 and a roll of pavement-marking tape 5 is unwindably supported in grooves 4 formed in the upper portion of the applicator 2. An unwound length of tape 5 is guided in front of the application roller 3 via a guide roller 6. By actuating a lever 8 of a tape gripping mechanism 7 constructed of a link, length of tape 5 is fed out and caused to be engaged by the application roller 3. The tape 5 can be cut by depressing a pedal 10 of cutting means 9.

In starting application of tape by causing the tape 5 to be engaged by the application roller 3 in this prior art tape application apparatus, the lever 8 of the tape gripping mechanism 7 is pushed forward to cause the foremost end portion of the gripping mechanism 7 to grip the tape 5 and pull it downwardly.

Since the tape gripping mechanism 7 feeds out a constant length of tape 5, there is likelihood that the tape 5 will be applied on the paved surface in a wrinkled state if the tape 5 is fed excessively whereas the tape 5 will not reach the paved surface and therefore will not be applied on the paved surface even if the applicator 2 is advanced, if length of tape fed out is insufficient.

Again, since the tape gripping mechanism, 7 releases the tape 5 when the tape 5 is applied on the paved surface, when the applicator 2 has stopped its advance, the tape 5 may be fed out in front of the application roller 3 in a loosened state due to inertia of rotation of the roll of tape 5 and this will cause the tape 5 to become creased in next application.

Further, the cutting means in the prior art tape application apparatus comprises a knife blade extending between the forward ends of two arms mounted each on side panels of the frame and cross lengths of tape 5 and a corresponding receiving plate, and the tape is cut by this knife blade and receiving plate. If it is attempted in such prior art apparatus to sharpen the knife blade by reducing the thickness of the blade for cutting the tape more easily, the knife blade tends to be bent in cutting and therefore is unusable. Therefore, there is a certain limit in reducing the thickness of the blade. Besides, since the blade is relatively thick, a gap tends to take place between the engaging portions of the blade and the receiving plate and this imposes an obstacle to facilitating cutting of the tape. Moreover, if the knife blade is damaged even partly, the tape is left uncut in this portion so that the entire knife blade must be replaced.

It is, therefore, an object of the invention to provide a pavement-marking tape applicator capable of fine adjustment of the amount of tape feeding and also capable of preventing slackening of tape in front of an applicator roller.

It is another object of the invention to provide a pavement-marking tape applicator capable of cutting pavement-marking tape very easily.

It is still another object of the invention to provide a pavement-marking tape applicator of improved efficiency which has comprehensively overcome the above described problems in the prior art.

SUMMARY OF THE INVENTION

A pavement-marking tape applicator achieving the above described first object of the invention is characterized in that it comprises a carrier having at least one wheel and an application roller for engaging a pavement-marking tape and applying the same on a paved surface while rolling on the paved surface, means for supporting a roll of the pavement-marking tape unwindably on the carrier, a pair of free end position adjusting rollers mounted on the carrier for holding the tape unwound from the roll between them for hanging the tape in front of the application roller in the advancing direction of the carrier and adjusting a free end position of the tape, and drive means mounted on the carrier for rotating one of the free end position adjusting rollers during adjusting of the free end position of the tape.

According to the invention, the free end of the pavement-marking tape is held by the pair of free end position adjusting rollers and the free end of the tape is brought to a desired position by driving one of the adjusting rollers by the drive means during adjustment of the tape free end position whereas during application of the tape on the paved surface, the rollers are rotated idly. Accordingly, the amount of tape fed out from the roll is not a constant amount as in the prior art apparatus employing the tape gripping mechanism constructed of a link but it can be adjusted as desired. This prevents slackening of the tape and resulting occurrence of wrinkles on the free end portion of the tape at the start of application of the tape on the paved surface. Besides, since the tape is held between the pair of free end position adjusting rollers, the tape is held under tension during the application operation so that the tape does not become slack during application. Furthermore, by adjusting the gap between the rollers and pressure applied to the tape by the rollers, the applicator can be applied to pavement-marking tape of any thickness so that tape of any thickness can be fed smoothly for application on the paved surface.

A pavement-marking tape application achieving the second object of the invention is characterized in that it comprises a carrier having at least one wheel and an application roller for engaging a pavement-marking tape and applying the same on a paved surface while rolling on the paved surface, means for supporting a roll of the pavement-marking tape unwindably on the carrier, means for hanging the tape unwound from the roll in front of the application roller in the advancing direction of the carrier, and cutting means mounted on the carrier for cutting the tape, the cutting means comprising a rail extending transversely of the moving direction of the carrier, a rotary blade support member having rail engaging means for engaging with the rail for sliding movement along the rail, a disc-like rotary blade supported by the rotary blade support member in such a manner that the rotary blade can be rotated horizontally, a stationary blade mounted on the carrier for cutting the tape in association with the rotary blade, and actuating means for actuating the rotary blade support member for the sliding movement along the rail.

According to the invention, by actuating the rotary blade support member upon completion of application of the tape, the rotary blade support member slides along the rail with a result that the the disc-like rotary blade comes into engagement with the tape and is thereby rotated, cutting the tape in association with the stationary blade. Since the disc-like rotary blade is used for the cutting means, the thickness of the blade can be reduced to a much greater degree than in the prior art knife blade so that a sharper blade can be obtained and moreover the gap between the rotary blade and the stationary blade can be reduced to the minimum and made substantially uniform. This enables cutting of the tape to be remarkably facilitated. Besides, by using the rotary blade, even if the rotary blade is partly damaged, this does not impose an obstacle to cutting of the tape so it is not necessary to replace the blade by a new one. Further, replacement of the rotary blade becomes simple as compared with the prior art apparatus.

A pavement-marking tape applicator achieving the third object of the invention is characterized in that it comprises a carrier having at least one wheel and an application roller for engaging a pavement-marking tape and applying the same on a paved surface while rolling on the paved surface, means for supporting a roll of the pavement-marking tape unwindably on the carrier, a pair of free end position adjusting rollers mounted on the carrier for holding the tape unwound from the roll between them for hanging the tape in front of the application roller in the advancing direction of the carrier and adjusting a free end position of the tape, drive means mounted on the carrier for rotating one of the free end position adjusting rollers during adjusting of the free end position of the tape, and cutting means mounted on the carrier for cutting the tape, the cutting means comprising a rail extending transversely of the moving direction of the carrier, a rotary blade support member having rail engaging means for engaging with the rail for sliding movement along the rail, a disc-like rotary blade supported by the rotary blade support member in such a manner that the rotary blade can be rotated horizontally, a stationary blade mounted on the carrier for cutting the tape in association with the rotary blade, and actuating means for actuating the rotary blade support member for the sliding movement along the rail.

According to the invention, a pavement-marking applicator with improved efficiency which is capable of performing fine adjustment of the amount of tape feeding and cutting the tape easily and thereby has comprehensively overcome the problems of the prior art apparatus is provided.

Preferred embodiments of the invention will be described below in conjunction with the accompanying drawings.

BRIEF DESCRIPTION OF THE DRAWINGS

In the accompanying drawings,

FIGS. 1 through 5 show a preferred embodiment of the pavement-marking applicator according to the invention in which, FIG. 1 is a side elevational view of the applicator;

FIG. 2 is a plan view thereof;

FIG. 3 is a plan view of cutting means;

FIG. 4 is a fragmentary enlarged side elevational view of the cutting means; and FIG. 5 is a fragmentary enlarged side elevational view showing a modified example of the cutting means;

FIGS. 6 through 9 show another embodiment of the pavement-marking tape applicator according to the invention in which, FIG. 6 is a side elevational view of the applicator;

FIG. 7 is a front view thereof;

FIG. 8 is a plan view of drive means for free end position adjusting rollers; and FIGS. 9*a* and 9*b* are side elevational view and fragmentary plan view of a cutter employed therein.

DESCRIPTION OF PREFERRED EMBODIMENTS

Figure 1:
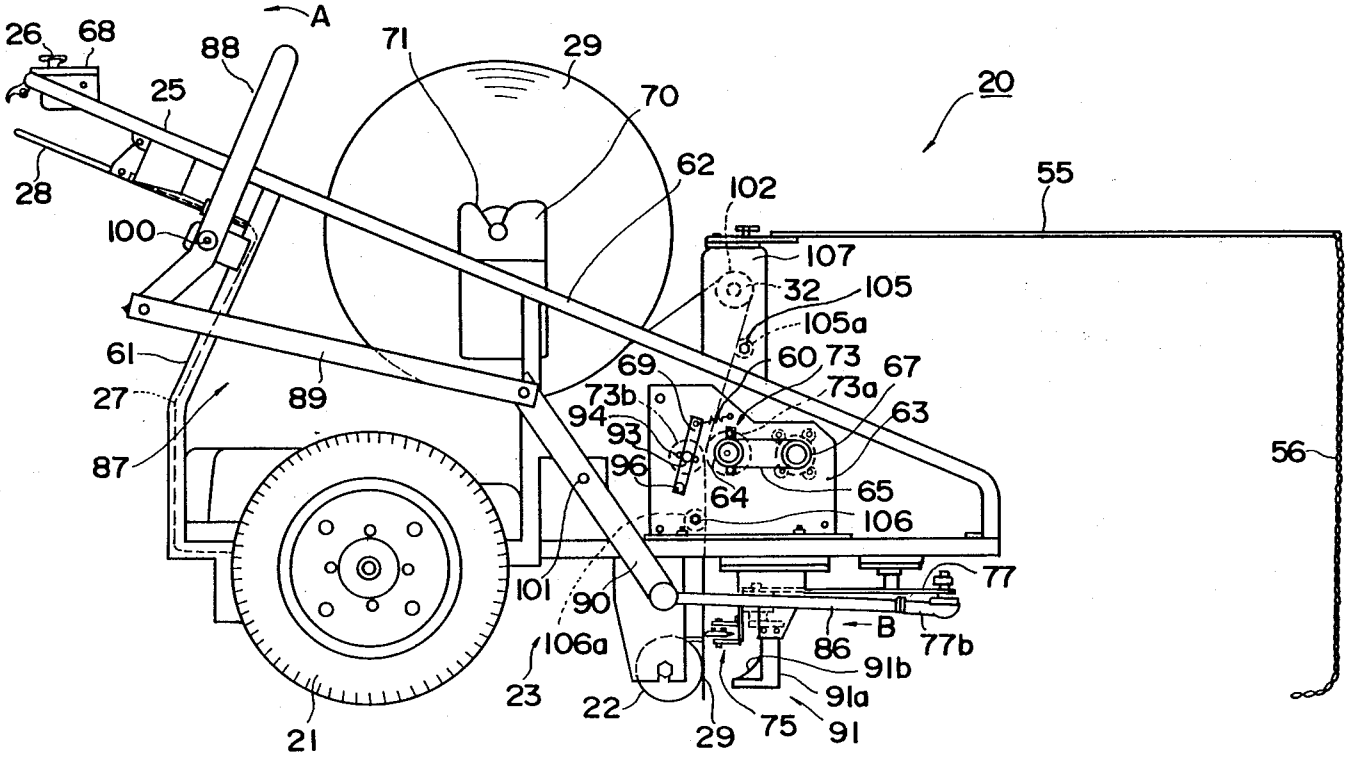

A preferred embodiment of the pavement-marking tape applicator according to the invention will now be described with reference to FIGS. 1 through 5. In FIG. 2, a part of a guide bar 55 and support members 107 for guide rollers 32 are omitted for convenience of illustration.

A pavement-marking tape applicator 20 comprises a carrier 23 which has a pair of rear wheels 21 and a single application roller 22 which serves a front wheel and moves along a paved surface on which tape is to be applied. The rear wheels 21 are driven and rotated by an unillustrated electric motor whose power is supplied from an unillustrated battery mounted on the carrier 23. The movement and stopping of the carrier 23 is controlled by a drive switch 26 mounted on a handle 25. Brakes provided for the rear wheels 21 are controlled by operating a brake lever 28 via a wire 27 provided through a tube 61 fixedly secured to the handle 25. The application roller 22 is made of rubber so as to press pavement-marking tape 29 against the paved surface without damaging the tape.

Side panels 70 are mounted on a frame 62 of the carrier 23 and these panels 70 are formed in the upper portions thereof with tape support grooves 71 for rotatably supporting the end portions of a shaft of a pair of rolls of pavement-marking tape 29. The rolls of tape 29 which are supported in the tape support grooves 71 are unwound and lengths of tape 29 are fed through a pair of guide rollers 32 to a pair of free end position adjusting rollers 73.

The guide rollers 32 and rollers 73*a* and 73*b* to be described later are respectively supported on support members 107 and side panels 63 by means of shafts 102, 97 and 93 fixed to the outer end portions of these rollers. The other end portions of these rollers 32, 73*a* and 73*b* are hollow and spindles 104, 99 and 103 are inserted in the hollow portions of each pair of the rollers 32, 73*a* and 73*b* through bearings (no shown). This arrangement enables the respective rollers 32, 73*a* and 73*b* to be rotated independently one from the other between each pair of these rollers.

The free end position adjusting rollers 73 consist of the front pair of rollers 73*a* and the rear pair of rollers 73*b*. As shown in FIG. 2, the front rollers 73*a* have shafts 97 fixed to the outer end thereof and these shafts 97 are inserted in openings formed in the side panels 63 and supported therein by means of bearings 98, the outer end portions thereof being projecting outwardly. These front rollers 73*a* are positioned in such a manner that the tape 29 which hangs from the front rollers 73*a* is brought into contact with the front surface of the application roller 22 as viewed in the advancing direction of the applicator 20. A rod 96 (see FIG. 1) is fixed in its end portions to the side panels 63 with the end portions projecting outwardly from the side panels 63. A pair of levers 69 are pivotably mounted in their one end portions on the projecting portions of the rod 96 outside of the side panels 63. The rear rollers 73*b* are rotatably mounted, by means of bearings (not shown), on a shaft 93 having its end portions fixed to the central portions of these levers 69. In portions of the side panels 63 in which the shaft 93 is inserted, there are formed slots 94 extending substantially in the moving direction of the applicator 20. Coil springs 60 are secured to the other end portions of these levers 69 and the levers 69 are urged in the clockwise direction as viewed in FIG. 1. Therefore, the tape 29 is held between the rollers 73*a* and 73*b* with the rollers 73*b* always being pressed against the rollers 73*a*.

The front rollers 73*a* are so arranged that they are driven and rotated independently from each other by drive means. More specifically, gear wheels 64 are fixed to the end portions of the shafts 97 projecting from the side panels 63. These gear wheels 64 are connected through chains 65 to gear wheels 67 fixed to rotation shafts of a pair of electric motor 66 which are mounted on the side panels 63. By switching on and off switches 68*a* and 68*b* provided on a switch board 68 in correspondence to the electric motors 66 during adjusting the free end position of the tape 29, the rollers 73*a* can be rotated for a desired period of time whereby the tape 29 of each roll can be fed out by a desired length.

Among the pairs of rollers 73, the front rollers 73*a* which come into contact with adhesive of the tape 29 are preferably made of silicone rollers, rubber rollers formed with projections and depressions on their surfaces or the like rollers whereas the rear rollers 73*b* are preferably made of steel rollers with rubber or plastic sheet bonded thereon or rubber rollers for preventing slipping.

Bolts 105 are provided between the pair of support members 107 and bolts 106 are provided between the pair of side panels 63 in such a manner that they cross the moving direction of the carrier 23 vertically and horizontally. These bolts 105 and 106 are provided respectively with two pairs of projections 105*a* and two pairs of projections 106*a* at positions at which the tape 29 hangs. Each pair of these projections 105*a* and 106*a* are spaced apart from each other with an interval slightly greater than the width of the tape 29 and prevent offsetting of the tape 29 in the lateral direction from its predetermined hanging position.

A pair of cutters 75 which constitute the cutting means for cutting the tape 29 to a predetermined length is mounted on the carrier 23 above the application roller 22. The pair of cutters 75 are of the same construction in correspondence to the pair of rolls of tape 29.

Figure 3:
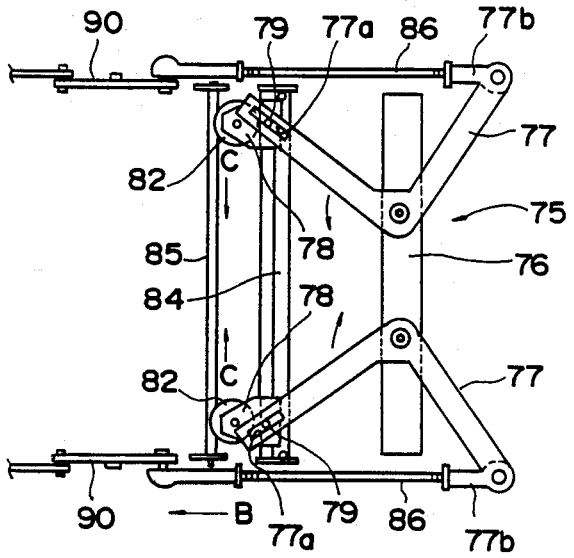

Each of the cutters 75 comprises, as shown in the plan view of FIG. 3, a pair of levers 77 which are substantially of an L-shape as viewed in the plan and are pivotably mounted on a support member 76 which in turn is fixed to the lower surface of the frame 62. The rear end portions (i.e., end portions nearer to the tape 29) of the levers 77 are formed with slots 77*a*. Engaging portions 79 of rotary blade support members 78 are slidably inserted in these slots 77*a* as shown in the fragmentary enlarged view of FIG. 4. The rotary blade support members 78 each comprise an arm portion 80 of a substantially L-shape as viewed in a side elevation which is provided on the top surface thereof with the engaging portion 79 and also comprise a slide block 81 which is fixed to the arm portion 80 by means of screws 150. Support plates 80*a* and 80*b* arranged vertically are provided on the surface opposing the tape 29 and a disc-like rotary blade 82 having a tapered peripheral portion with a cross section of an acute-angle triangle is mounted rotatably in the horizontal direction between the support plates 80*a* and 80*b*. The slide block 81 is formed in the lower portion thereof the a recess 81*a* extending transversely of the moving direction of the carrier 23. The recess 81*a* engages a rail 84 which is fixed to the frame 62 and extends transversely of the moving direction of the carrier 23. A pair of bearing chambers 81*b* are formed at positions adjacent to the recess 81*a* transversely of the moving direction of the carrier 23 and a plurality of steel balls 83 are housed in these bearing chambers 81*b*. This arrangement enables the rotary blade support member 78 to slide along the rail 84. A single stationary blade 85 which cuts the tape 29 in association with the rotary blade 82 is mounted on the frame 62 above the application roller 23 and at a position at which the stationary blade 85 is in contact with the rear surface of the tape 29.

A tubular portion 77*b* with a threaded inner surface is provided at the front end of each lever 77. A threaded end portion of a rod 86 is in threaded engagement with the inner surface of the tubular portion 77*b*. A lever 90 of a link 87 is pivotably connected to the other end portion of the rod 86. The link 87 consists of a cutter handle 88 and levers 89 and 90. The cutter handle 88, the levers 89 and 90 and the rod 86 are respectively pivotably connected to their adjacent members. The cutter handle 88 is pivotably connected to the frame 62 by means of a pin 100 and the lever 90 is pivotably connected to the frame 62 by means of a pin 101. Accordingly, by pulling the cutter handle 88 towards the operator (i.e., in the direction of arrow A), the rod 86 is pulled rearwardly in the direction of arrow B.

Figure 2:
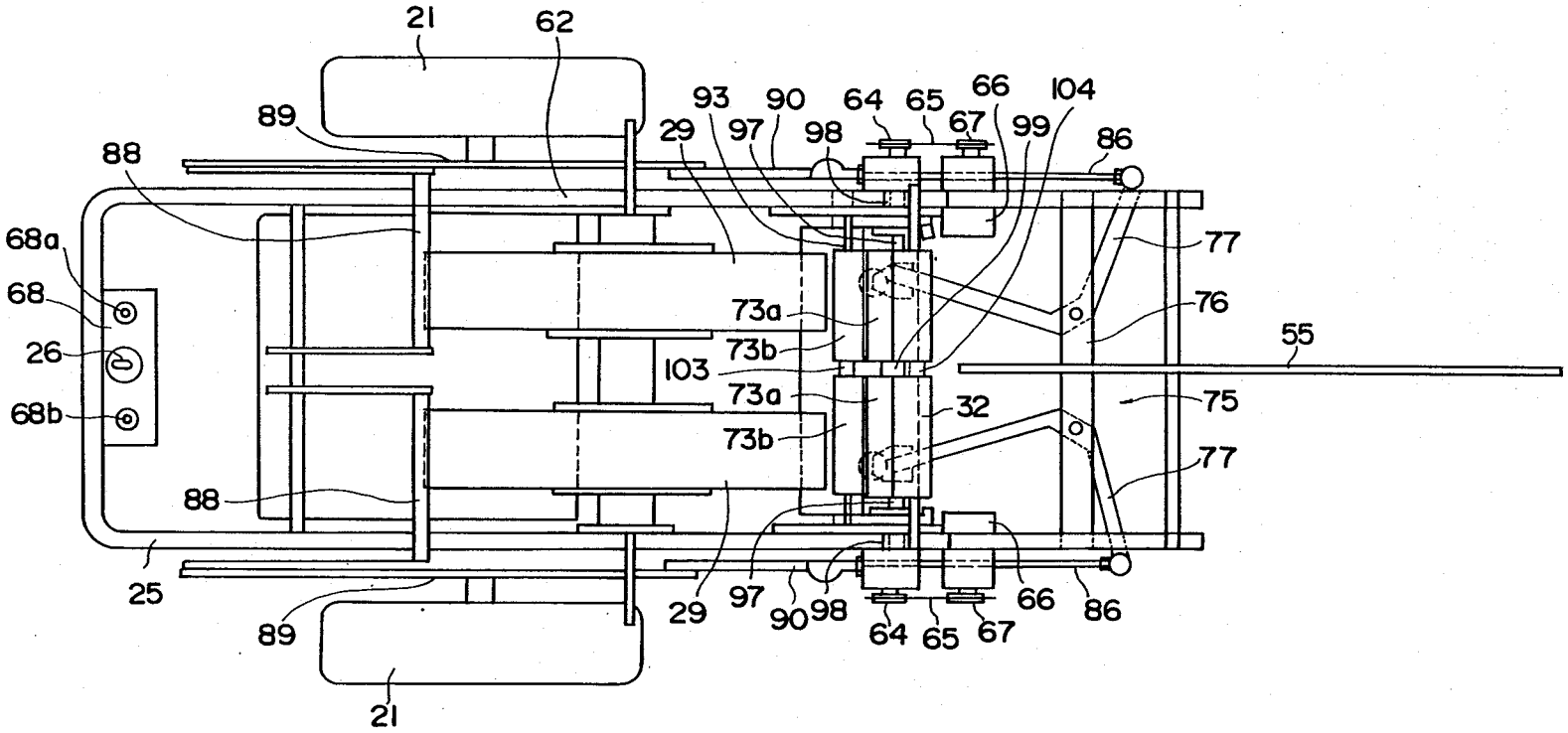

In FIG. 1, reference character 91 designates an obstacle removing device for removing obstacles such as pebbles, sands etc. existing ahead of the carrier 23 in the advancing direction of the carrier 23. The device 91 consists of a plate 91*a* of an L-shaped cross section and a plate 91*b* having a curved surface and fixed to the inside of the plate 91*a*. The plate 91*a* need not be made of a board but it may be made of other material such as a wire mesh provided on a frame if it can be used for removing the obstacles.

The tape applying operation by the pavementmarking tape applicator 20 of the above described embodiment will now be described with operations of the respective component parts.

First, the end portions of the shafts of two rolls of pavement-marking tape 29 for applying two lines of tape on the paved surface are positioned at the tape supporting grooves 71 for unwinding from the rolls. Then, the tape 29 from either one or both of the rolls is inserted between the pair of free end position adjusting rollers 73 via the guide rollers 32.

Then the switches 68*a* and/or 68*b* is operated to feed out the tape 29 downwardly and adjust the length of the fed out tape 29 in such a manner that the free end of the tape 29 will hang in front of the application roller 22 in the advancing direction of the carrier 23 and come into contact with the paved surface in its tip end portion.

After completion of preparation for application of the tape 29, the drive switch 26 mounted on the handle 25 is switched on to start the electric motor and the brake lever 28 is slowly released to advance the carrier 23.

In advancing of the carrier 23, care is taken to move the chain 56 connected to the guide bar 55 mounted on the support members 107 along a guide line which has previously been laid on the paved surface so as to prevent moving of the carrier 23 in a zigzag direction.

As the carrier 23 advances, the tape 29 with adhesive provided thereon is pressed by the application roller 22 against the paved surface and thereby applied on the paved surface. During this application of the tape 29, the pairs of the free end position adjusting rollers 73 are rotated idly by the fed out tape 29 so that the tape 29 is prevented from becoming slack.

Upon completion of application of the tape 29 for a predetermined length, the brake lever 28 is operated and the drive switch is switched off to stop the advancement of the carrier 23.

Then, the tape 29 is cut by the cutter 75. In a case where two lengths of tape 29 are simultaneously cut, both cutter blades 88 are pulled towards the operator whereas in a case where only one length of tape is cut, one corresponding cutter handle 88 is pulled towards the operator. As the cutter handle 88 is pulled towards the operator, the rod 86 is pulled in the direction of the arrow B through the link 87 to rotate the lever 77 in the direction of the arrow in FIG. 3. The rotary blade support member 78 thereby is caused to slide along the rail 84 in the direction of arrow C with the engaging portion 79 moving in the slot 77*a* of the lever 77 towards the outer end of the slot 77*a*. The rotating rotary blade 82 cuts the tape 29 in association with the stationary blade 85. In cutting of the tape 29, since the upper end portion of the hanging tape 29 is held by the pair of free end position adjusting rollers 73 and the lower end portion thereof is pressed by the application roller 22. the tape 29 is in a state under tension and can be cut very easily.

Figure 4:
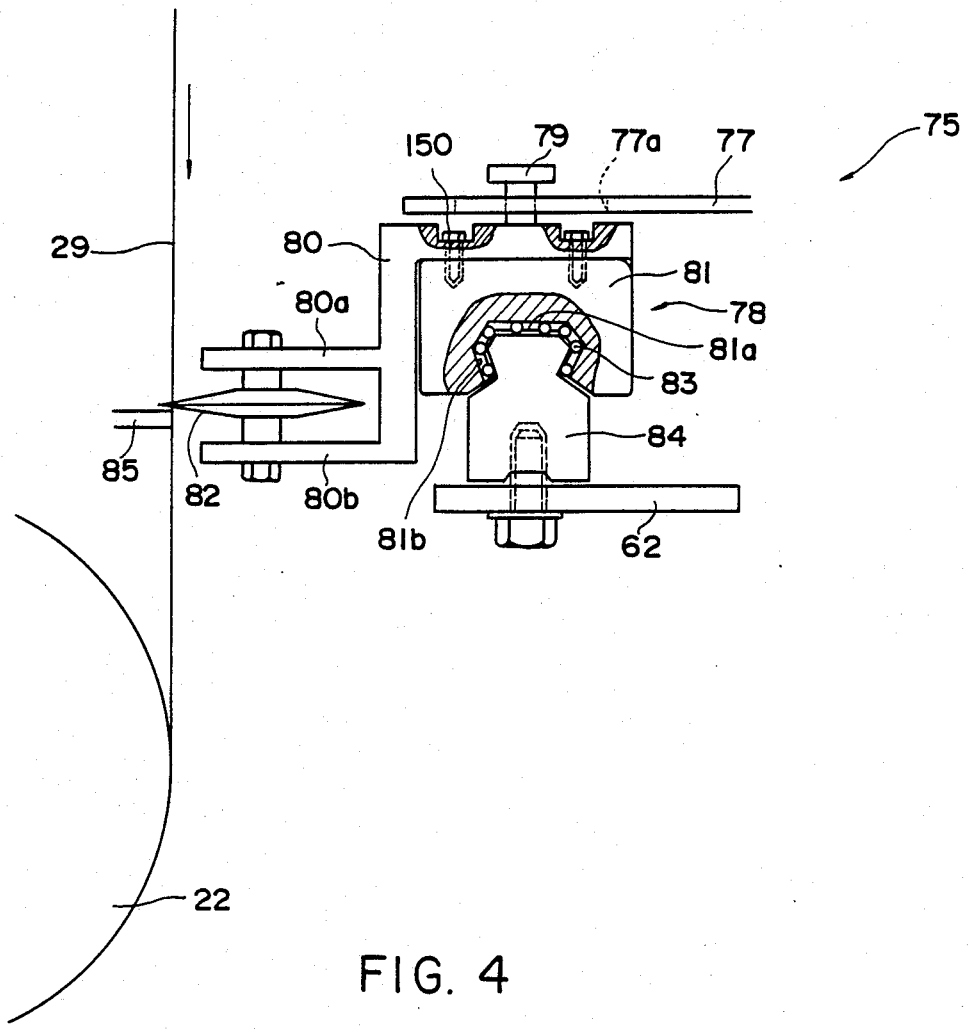
Figure 5:
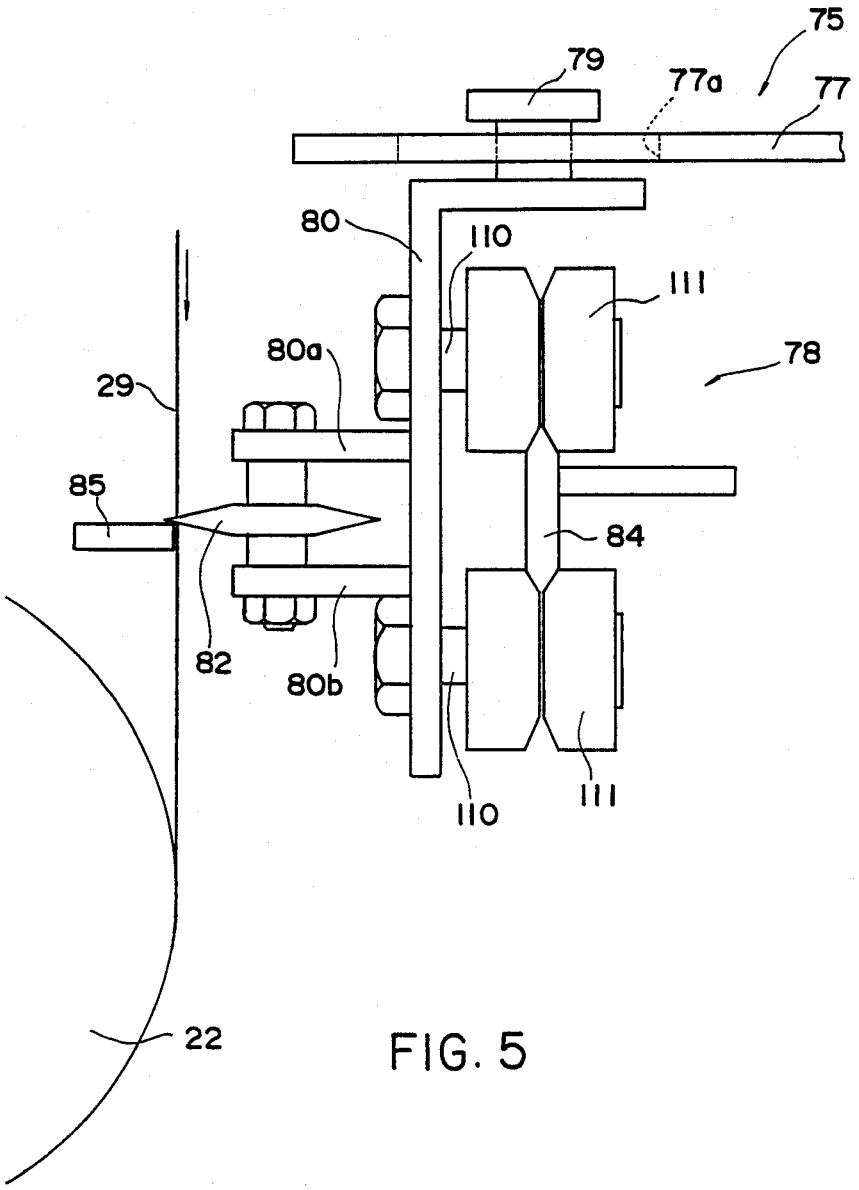
Figure 6:
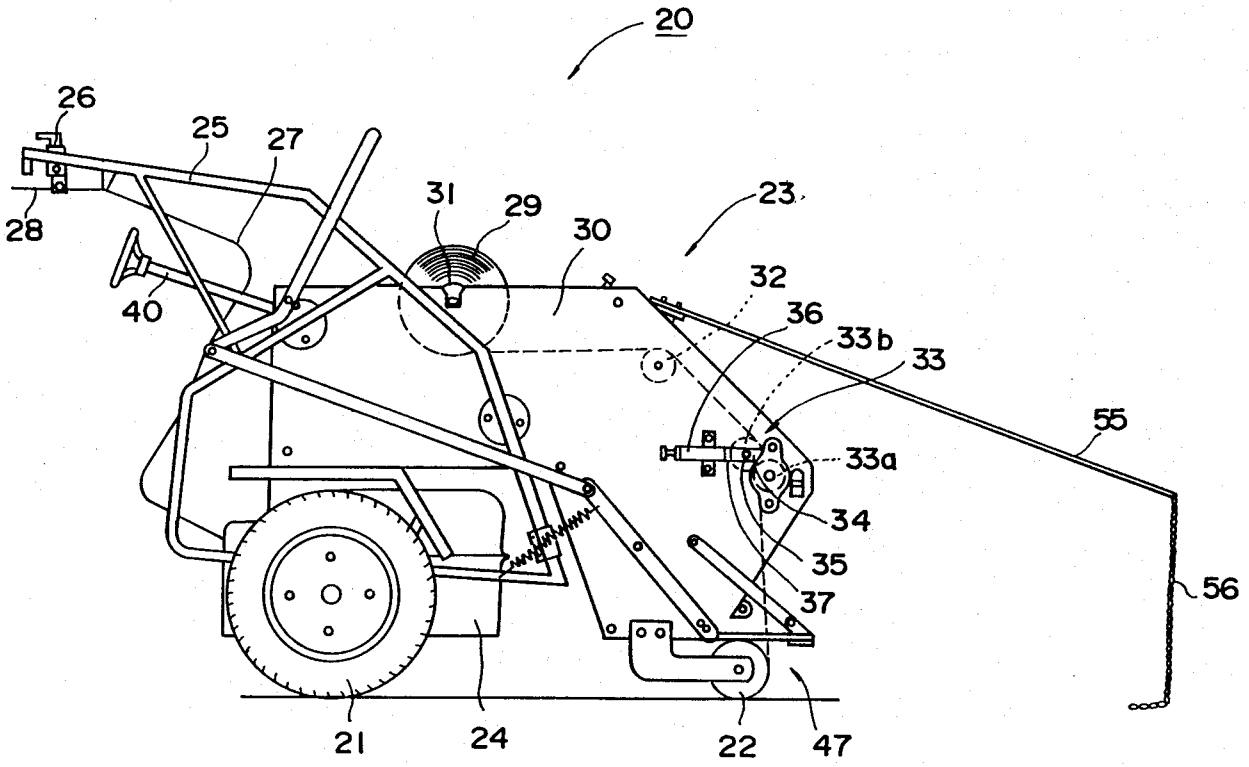
Figure 7:
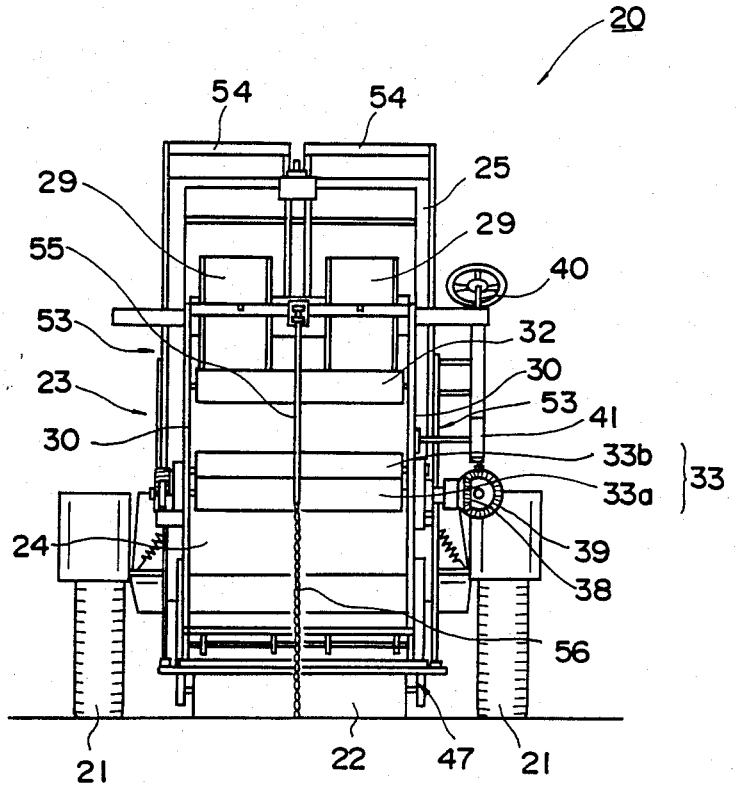
Figure 10:
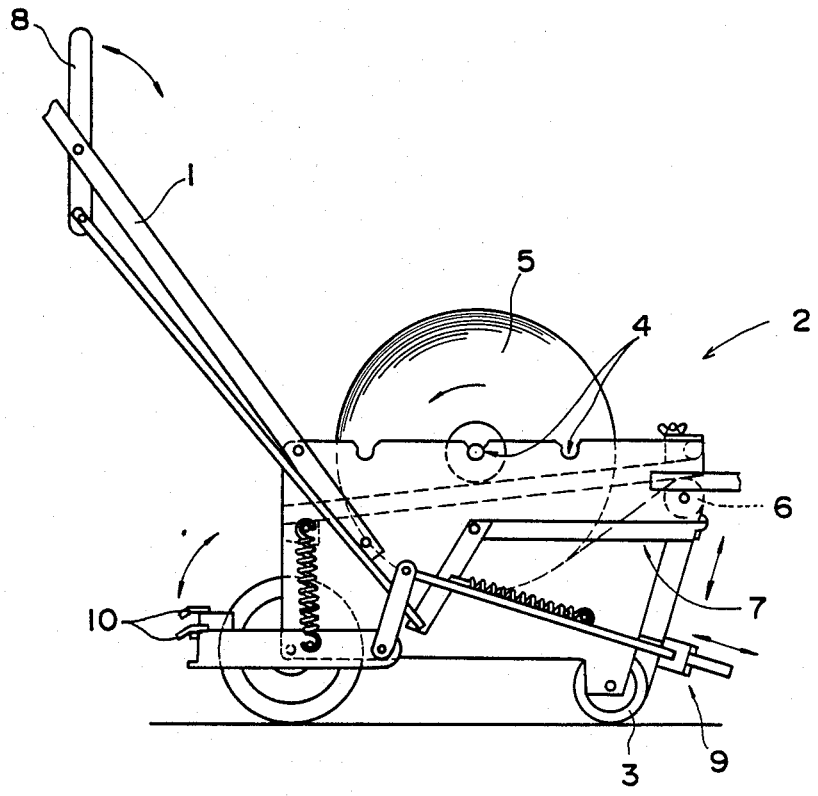
FIG. 10 PRIOR ART
FIG. 10 is a side elevational view of the prior art applicator.

If application of the tape 29 is to be resumed, the tape 29 is fed out again by operating the switch 68 and the above described operation is repeated Another example of the cutter 75 is shown in FIG. 5. In FIG. 5, the same or like component parts as in FIGS. 3 and 4 are designated by the same reference characters and detailed description thereof is omitted. A rotary blade support member 78 of the cutter 75 comprises an arm portion 80 of a substantially L-shape as viewed in a side elevation with an engaging portion 79 provided on the top surface thereof. On the opposite side of rotary blade support plates 80*a* and 80*b* of the arm portion 80 are fixed vertically arranged pairs of shafts 110 at two locations transversely of the moving direction of the carrier 23. Rollers 111 are rotatably mounted through bearings (not shown) on the respective shafts 110 in such a manner that these rollers engage the rail 84 mounted on the frame in the upper and lower surfaces thereof. Accordingly, by rotating a lever 77, the rollers 111 are caused to roll along the rail 84 and the tape 29 can be cut by the associating action of a rotary blade 82 and a stationary blade 85.

FIGS. 6 through 9 show another embodiment of the pavement-marking tape applicator according to the invention. In these figures, the same or like component parts as those in the embodiment shown in FIGS. 1 through 5 are designated by the same reference characters and description thereof is partly omitted.

The pavement-marking tape applicator 20 of this embodiment comprises a carrier 23 which has a pair of rear wheels 21 and a single application roller 22. The rear wheels 21 are driven by an unillustrated electric motor whose power is supplied by a battery 24. The carrier 23 has a pair of side panels 30 which each are formed in the upper portions thereof with tape support grooves 31. A pair of rolls of pavement-marking tape 29 are supported in these grooves 31 and are fed via a guide roller 32 to a pair of free end position adjusting rollers 33.

A front roller 33*a* of the free end position adjusting rollers 33 is positioned in such a manner that the tape 29 which is held between the rollers 33 is brought into contact with the front surface of the application roller 22. On the other hand, a rear roller 33*b* is mounted in guide slots 34 formed in the side panels 30 of the carrier 23. More specifically, inner races of ball bearings (not shown) are fitted on the end portions of a shaft of the roller 33*b* and outer races of these bearings are inserted in the guide slots 34. Spring supports 35 are fixed to portions of the outer races of these bearings projecting outwardly of the guide slots 34. These spring supports 35 are urged towards the front roller 33*a* by springs 37 provided between screw cylinders 36 and the spring supports 35. The pressing force of the rear roller 33*b* can be adjusted by adjusting the length of projection of the screw cylinder 36. The front roller 33*a* is driven a rotated by drive means to be described below. As shown in the enlarged view of FIG. 8, a driven bevel gear 38 is secured to one end portion of the front roller 33*a* and a drive bevel gear 39 which can be meshed with the bevel gear 38 is secured to the foremost end portion of an operation rod 40.

This operation rod 40 is inserted in a support pipe 41 mounted on one end of the side panels 30 of the carrier 23. A rotary ring 42 is rotatably mounted on the foremost end portion of the support pipe 41 and a spring 43 is provided between the rotary ring 42 and a base surface of the drive bevel gear 39. The drive bevel gear 39 is urged by this spring 43 in the direction in which the drive bevel gear 39 is brought into meshing engagement with the driven bevel gear 38. An engaging pipe 45 formed with an engaging recess 44 is mounted on the side panel 30 for disengaging the drive bevel gear 39 from the driven bevel gear 38 and thereby letting the rollers 33*a* and 33*b* rotate idly. The operation rod 40 is inserted in this engaging pipe 45. By pulling the operation rod 40 towards the operator to position a projection 46 fixed to the operation rod 40 in the recess 44 and causing this projection 46 to be engaged with the recess 44 by rotating the operation rod 40, the operation rod 40 can be held in the withdrawn position. It is to be noted that the mechanism for engaging the operation rod 40 in the withdrawn position is not limited to this but various other means man be adopted.

Accordingly, while adjusting the free end position of the tape 29, any desired length of tape 29 can be fed out by rotating the operation rod 40 in a state in which the bevel gears 38 and 39 are meshed with each other. During application of the tape 29 on the paved surface, the bevel gears 38 and 39 are disengaged from each other and the free end position adjusting rollers 33 are allowed to rotate idly whereby the tape 29 in front of the application roller 22 is prevented from becoming slack.

The front roller 33*a* which comes into contact with adhesive of the tape 29 is preferably made of a silicone roller, a rubber roller formed with projections and depressions on its surface or the like roller whereas the rear roller 33*b* is preferably made of a steel roller with rubber or plastic sheet bonded thereon or a rubber roller for preventing slipping.

A pair of cutters 47 for cutting the tape 29 to a predetermined length are mounted on the carrier 23 above the application roller 22. These cutters 47 are of the same construction in correspondence to the rolls of tape 29 mounted on the carrier 23. The cutter 47 on the right side in the advancing direction of the carrier 23 is shown in FIG. 9.

A stationary frame 49 formed with a rectangular opening and mounted with a stationary knife blade 48 at the base portion thereof is provided above the application roller 22. The frame 48 is formed on both sides thereof with slots 50 extending in the moving direction of the carrier 23. Support rods 57 of a movable knife blade 51 extending transversely of the moving direction of the carrier 23 are inserted in these slots 50 and the knife blade 51 is slidably mounted on the frame 49 by means of the support rods 57 and nuts 52 which are threaded on the top portions of the support rods 57.

One end lever of a link 53 consisting of four levers is connected to the outer end portions of the movable knife blade 51. By pulling a cutter handle 54 which constitutes the other end lever of the link 53 and is located in the vicinity of the handle 25 towards the operator, the movable knife blade 51 is caused to slide in the slots 50 horizontally and maintaining a state which is parallel with the transverse direction of the moving direction of the carrier 23 thereby cutting the tape 29 located in the rectangular opening of the frame 49.

The cutter 47 on the left side (not shown) is of the same construction as the one shown in FIG. 9. By operating the two cutter handles 54 simultaneously, the two lengths of tape 29 can be cut simultaneously. The tape 29 can also be cut independently by operating one of the cutter handles 54.

Since the upper portion of the hanging tape 29 is held between the pair of free end position adjusting rollers 33 and the free end portion of the tape 29 is pressed by the application roller 22, the tape 29 is in a state under tension so that the tape 29 can be cut very easily.

The tape applying operation by the pavementmarking tape applicator 20 of this embodiment will be described with operations of the respective component parts. Description of the same operation as the one described with respect to the previous embodiment will be partly or wholly omitted.

In a state before starting the tape applying operation, the operation rod 40 of the drive means is in its withdrawn position with the projection 46 being engaged in the recess 44 of the engaging pipe 45. After inserting the free end portion of the tape 29 through the pair of free end position adjusting rollers 33 via the guide roller 32, the screw cylinder 36 is operated to adjust the urging force of the spring 37 so that a desired pressing force compatible with the thickness of the tape 29 will be obtained. Then, the projection 46 of the operation rod 40 is disengaged from the recess 44 of the engaging pipe 45 and the drive bevel gear 39 is brought into meshing engagement with the driven bevel gear 38 by pushing the operation rod 40 forwardly.

The tape 29 is fed downwardly by rotating the operation rod 40 manually until the free end of the tape 29 hangs in front of the application roller 22 and comes into contact with the paved surface in its tip end portion. The adjustment of the free end position of the tape 29 can be made simply by adjusting the number of rotation of the operation rod 40. After completing the adjustment, the operation rod 40 is pulled towards the operator and stopped in its withdrawn position with the projection 46 being engaged in the recess 44 of the engaging pipe 45.

The operation for applying the tape 29 on the paved surface is conducted in the same manner as described before with respect to the previously described embodiment.

In cutting the tape 29 after completion of the tape applying operation, one or both of the two cutter handles 54 are pulled towards the operator depending upon whether one or both of the two rolls of tape 29 is to be cut. This causes the movable knife blade 51 to slide in a parallel state towards the stationary knife blade 48 and cut the tape 29.

When the tape applying operation is to be resumed, the operation rod 40 is advanced to bring the bevel gears 38 and 39 into meshing engagement with each other and then the tape 29 is fed out and the above described operation is repeated.

In the above described embodiments, the carrier 23 is moved on the paved surface by the electric motor mounted thereon but the carrier may be moved by other drive source or may be pushed manually.

In the above described embodiments, there are provided a pair of rear wheels 21 and a single application roller 22. The arrangement of wheels and an application roller however is not limited to this but there can be various combinations of a wheel or wheels and an application roller. For example, there may be provided a single rear wheel instead of two. Alternatively, there may be provided a single wheel or a pair of wheels in the front portion of the carrier 23 and the application roller may be provided in the rear portion of the carrier 23. In the case where the application roller is provided in the rear portion of the carrier 23, the guide roller 32 may be provided in the upper rear portion of the carrier.

The drive means for rotating one of the free end position adjusting rollers may be manually operated as in the present embodiment or electrically operated as in the previously described embodiment.

In the above described embodiments, the cutters 47 and 75 are manually operated by means of the cutter handles 54 and 88. The cutters may however be operated manually by means other than the cutter handles. Alternatively, the cutters may be driven electrically or by a hydraulic or pneumatic system to alleviate the operator's labor.

What is claimed is:

1. A pavement-marking tape applicator comprising:

a carrier having at least one wheel and an application roller for engaging a pavement-marking tape and applying the same on a paved surface while rolling on the paved surface;

means for supporting a roll of the pavement-marking tape unwindably on said carrier;

a pair of free end position adjusting rollers mounted on said carrier for holding the tape unwound from the roll between them for hanging the tape in front of said application roller in the advancing direction of said carrier and adjusting a free end position of the tape; and drive means mounted on said carrier and operated by an operator for rotating one of said free end position adjusting rollers independently from rotation of said application roller and selectively in forward or reverse direction during adjusting of the free end position of the tape.

2. A pavement-marking tape applicator as defined in claim 1 wherein said drive means comprises an electric motor mounted on said carrier and drive force transmission means for transmitting drive force of said electric motor to said one free end position adjusting roller.

3. A pavement-marking tape applicator as defined in claim 1 wherein said drive means is manually operated for rotating said one free end position adjusting roller.

4. A pavement-marking tape applicator comprising:

a carrier having at least one wheel and an application roller for engaging a pavement-marking tape and applying the same on a paved surface while rolling on the paved surface;

means for supporting a roll of the pavement-marking tape unwindably on said carrier;

a pair of free end position adjusting rollers mounted on said carrier for holding the tape unwound from the roll between them for hanging the tape in front of said application roller in the advancing direction of said carrier and adjusting a free end position of the tape;

drive means mounted on said carrier and operated by an operator for rotating one of said free end position adjusting rollers independently from rotation of said application roller and selectively in forward and reverse direction during adjusting of the free end position of the tape; and cutting means mounted on said carrier for cutting the tape;

said cutting means comprising:

a rail extending transversely of the moving direction of said carrier;

a rotary blade support member having rail engaging means for engaging with said rail for sliding movement along said rail;

a disc-like rotary blade supported by said rotary blade support member in such a manner that said rotary blade can be rotated horizontally; and actuating means for actuating said rotary blade support member for the sliding movement along said rail.

5. A pavement-marking tape applicator as defined in claim 4 wherein said drive means comprises an electric motor mounted on said carrier and drive force transmission means for transmitting drive force of said electric motor to said one free end position adjusting roller.

6. A pavement-marking tape applicator as defined in claim 4 wherein said drive means is manually operated for rotating said one free end position adjusting roller.

7. A pavement-marking tape applicator as defined in claim 4 wherein said actuating means comprises:

a pair of levers pivotably mounted on a support member provided on said carrier and each having a slot in one end portion thereof; and an engaging portion provided on each of said rotary blade support members for engaging in said slot of said lever.

8. A pavement-marking tape applicator as defined in claim 4 wherein said rail engaging means comprises a recess formed in the lower portion of said rotary blade support member and said rail is engaged in said recess.

9. A pavement-marking tape applicator as defined in claim 4 wherein said rail engaging means comprises a pair of rollers which engages said rail in the upper and lower surfaces thereof.

* * * * *